US009784014B2

(12) United States Patent
Meissner et al.

(10) Patent No.: US 9,784,014 B2
(45) Date of Patent: Oct. 10, 2017

(54) LOCK-KEY SYSTEM

(75) Inventors: Peter Meissner, Berlin (DE); Joachim Gillert, Berlin (DE)

(73) Assignee: ASSA ABLOY SICHERHEITSTECHNIK GMBH, Albstadt (DE)

( * ) Notice: Subject to any disclaimer, the term of this patent is extended or adjusted under 35 U.S.C. 154(b) by 880 days.

(21) Appl. No.: 13/501,987

(22) PCT Filed: Oct. 8, 2010

(86) PCT No.: PCT/DE2010/001191
§ 371 (c)(1),
(2), (4) Date: Jun. 27, 2012

(87) PCT Pub. No.: WO2011/044880
PCT Pub. Date: Apr. 21, 2011

(65) Prior Publication Data

US 2012/0272699 A1 Nov. 1, 2012

(30) Foreign Application Priority Data

Oct. 16, 2009 (DE) ..... 20 2009 014 283 U
Nov. 4, 2009 (DE) ..... 20 2009 015 088 U
Jan. 28, 2010 (DE) ..... 10 2010 006 886

(51) Int. Cl.
*E05B 19/02* (2006.01)
*E05B 19/08* (2006.01)
*E05B 19/00* (2006.01)

(52) U.S. Cl.
CPC ..... *E05B 19/0023* (2013.01); *Y10T 70/7842* (2015.04); *Y10T 70/7864* (2015.04); *Y10T 70/7881* (2015.04)

(58) Field of Classification Search
CPC ..... E05B 19/0064; E05B 19/0023; E05B 27/0017; Y10T 70/7864; Y10T 70/7842; Y10T 70/7881
(Continued)

(56) References Cited

U.S. PATENT DOCUMENTS 1,458,520 A * 6/1923 Castell ..... 70/356
1,701,785 A 2/1929 Lino
(Continued)

FOREIGN PATENT DOCUMENTS

DE 195 19 600 A1 10/1995
FR 2 669 366 A1 5/1992
GB 2 078 843 A 1/1982

OTHER PUBLICATIONS

Anonymous: "Simple Symbol Meaning", Whats-Your-Sign.com The Doorway to Signs and Symbolic Meanings, http://whats-your-sign.com/simple-symbol-meaning.html.

*Primary Examiner* — Lloyd Gall
(74) *Attorney, Agent, or Firm* — Henry M. Feiereisen LLC

(57) ABSTRACT

The invention relates to a lock-key system, including a key that is insertable into a key channel of a lock cylinder, and traceable by core pins or by locking elements that are displaceable in the cylinder core, wherein in case of a match, the cylinder core can be rotated by means of the inserted key. Lettering in the form of an impression and/or an embossment, serving as an identifier and including letters and/or numbers and/or symbols, is introduced into at least one lateral surface of the key shank and in case of a lateral profiling, into the lateral profiling. The lettering or individual letters, numbers, or the symbol or sub-areas thereof are traceable by core pins or locking elements having a correspondingly formed contact surface.

2 Claims, 1 Drawing Sheet

(58) Field of Classification Search
USPC ..... 70/409, 460, 378, 392, 493
See application file for complete search history.

(56) References Cited

U.S. PATENT DOCUMENTS

| | | | | |
|---|---|---|---|---|
| 4,325,241 | A * | 4/1982 | Keller | 70/358 |
| 4,553,452 | A | 11/1985 | Keller | |
| 5,146,770 | A * | 9/1992 | Yun-Sheng | 70/38 C |
| 6,102,288 | A * | 8/2000 | Merchel | 235/383 |
| 6,615,628 | B2 * | 9/2003 | Lou | 70/409 |
| 6,637,245 | B1 * | 10/2003 | Bolton | 70/408 |
| 2004/0079125 | A1 * | 4/2004 | Morehart et al. | 70/408 |
| 2005/0072198 | A1 * | 4/2005 | Casellini et al. | 70/408 |

* cited by examiner

LOCK-KEY SYSTEM

CROSS-REFERENCES TO RELATED APPLICATIONS

This application is the U.S. National Stage of International Application No. PCT/DE2010/001191, filed Oct. 8, 2010, which designated the United States and has been published as International Publication No. WO 2011/044880 A2 and which claims the priority of German Patent Application, Serial No. 20 2009 014 283.3, filed Oct. 16, 2009, German Patent Application, Serial No 20 2009 015 088.7 filed Nov. 4, 2009 and German Patent Application, Serial No 10 2010 006 886.1 filed Jan. 28, 2010 pursuant to 35 U.S.C. 119(a)-(d).

BACKGROUND OF THE INVENTION

The invention relates to a lock-key system, with a key which can be inserted into a keyway of a locking cylinder, and which is traceable by core pins or by locking elements which are shiftable in the cylinder core, wherein in case of a match the cylinder core can be turned by the key.

These types of key systems are known.

Keys can be lost and have to be reordered, often however there is the demand to have additional keys made.

SUMMARY OF THE INVENTION

The copying of keys can be impeded by security cards which have to be presented for a reorder. The unauthorized copying however can hardly be prevented in praxis. This circumstance is not changed by protected profiles, since nowadays copying machines are on the market which are able to copy these profiles as well.

The invention is based on the object to provide a lock-key system which offers increased protection against unauthorized copying of keys.

This object is solved on one hand with a key-lock system, with a key which can be inserted into a keyway of a locking cylinder, and which is traceable by core pins or by locking elements which are shiftable in the cylinder core, wherein in case of a match the cylinder core can be turned by the key, in that a lettering in the form of an impression and/or embossment which serves as identifier and includes letters and/or numbers and/or symbols is introduced on the side surfaces of the key shaft, and in that the lettering or individual letters, numbers or the symbol or partial areas of the same are traceable by core pins or locking elements, which are configured complementary in their contact surfaces.

In profiled flat keys, this object is solved with a lock-key system, with a flat key which can be inserted into a keyway of a locking cylinder, which flat key has profilings on the side surfaces of the key shaft which are formed as grooves and embossments and extend in longitudinal direction of the key shaft and which are at least partially traceable by core pins or locking elements which are shiftable in the cylinder core and which interact with recesses in the cylinder housing which lie outside of the separation plane cylinder core/cylinder housing, wherein in case of a match the cylinder can be turned by the key, in that a lettering in the form of an impression and/or embossment which serves as identifier and includes letters and/or numbers and/or symbols is introduced on the side surfaces of the key shaft, and in that the lettering or individual letters, numbers or the symbol or partial areas of the same is or are traceable by core pins or locking elements, which are configured complementary in their contact surfaces.

Preferably, the lettering, individual letters, numbers or symbols which serve as identifier should represent an identification which is registered as trademark.

In this type of lock-key system the locking process can only be carried out when the core pins or locking elements match at the separation plane cylinder core/cylinder housing, i.e. a matching key was inserted into the keyway, because the tracing of the identifier is additionally required.

The copying of the identifier requires special tools in contrast to the milling devices with which the profilings are produced on the key.

In addition, when a protected lettering or a corresponding letter or number combination or a protected logo forms the identifier, imitation can trigger an infringement process which is not without consequences for the imitator.

BRIEF DESCRIPTION OF THE DRAWING

In the following, the invention is explained with reference to the exemplary embodiments shown in the drawings.

It is shown in

In both Figures corresponding parts are designated the same.

DETAILED DESCRIPTION OF PREFERRED EMBODIMENTS

Both flat keys have a bow 2 and a shaft 1. Grooves 3 are provided on the key chest. These interact in a conventional way with core and housing pins.

Figure 1:
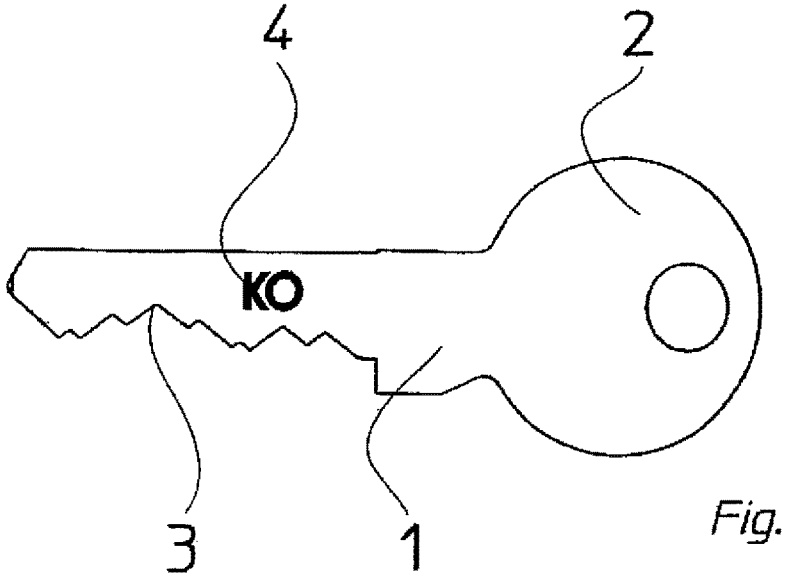
FIG. 1 schematically a flat key without lateral profiling.
Figure 2:
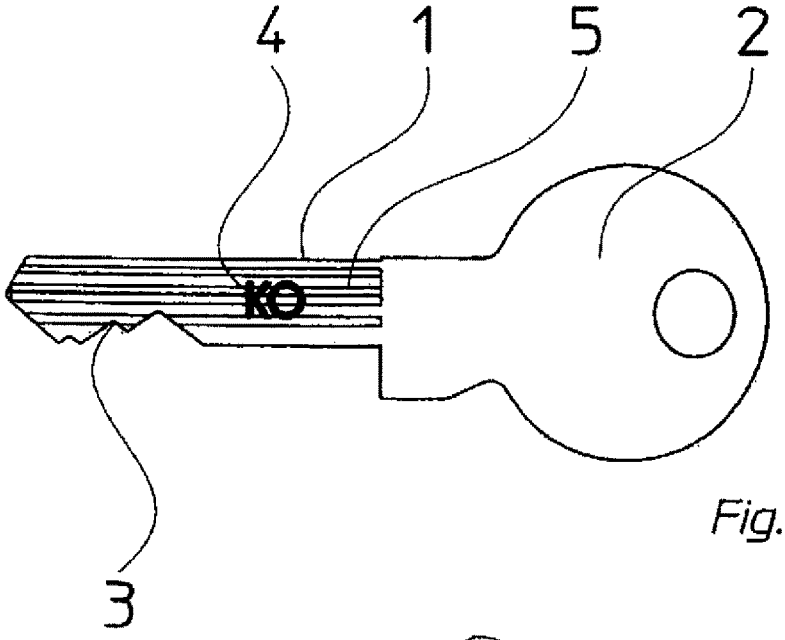
FIG. 2 schematically a flat key with lateral profiling

In FIG. 2 the grooves are shown symbolically only over a partial length of the shaft. In the embodiment according to FIG. 2 profilings extend along the shaft in the form of longitudinal grooves and embossments.

According to the invention, an identifier 4 is worked in at least on one of the longitudinal sides of the shaft—in the embodiment according to FIG. 2 in addition to the profiling—which identifier in the shown example is formed by the letters "KO".

This identifier should preferably be a registered, i.e. protected, trademark, wherein it can be a lettering, letter, numbers or symbols (logos).

Figure 3:
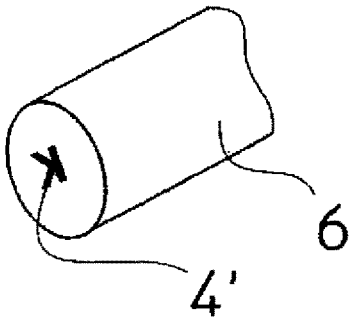
FIG. 3 schematically a core pin with its contact surface.

Relevant is that not only the profiling of the key—if present—is mechanically scanned, but also the identifier 4. This takes place by core pins or other locking elements which are displaceable, i.e. shiftable, in the cylinder core. In FIG. 3 a core pin is indicated as example, which has a corresponding contact surface 4'. The later is formed in its entirety or only partially depending on the topography of the identifier on the key. However, it is relevant that these core pins have contact surfaces which correspond to the identifier which is introduced on the sides of the key, i.e. surfaces which can be brought into engagement with the identifier, which have positive or negative regions which correspond to the identifier.

These core pins or locking elements form a type of stamp in the region of contact.

Thus, for causing a match of the core pins or locking elements at the separation plane cylinder core/cylinder housing the match between the identifier with the region contained on the core pin or locking element is necessary.

The impressions or embossments of these regions can vary and thus even increase the complexity of the key-lock system.

The relevant difference to the simple lateral pin query is thus that not only one point or plane, but an entire contour and/or topography can be queried.

A copy of this type of keys thus requires significantly more effort or is even impossible and on the other hand represents an infringement in the case of imitation of a protected trade mark.

What is claimed is:

1. A lock-key system, comprising:

a flat key insertable into a keyway of a lock cylinder, said flat key having a shaft, said shaft having side surfaces, said side surfaces being provided with profilings formed as grooves and elevations and extending in longitudinal direction along the shaft, said profilings being provided with a lettering in the form of at least one of impressions and embossments, said lettering comprising at least one member selected from the group consisting of a letter, a number and a symbol; and locking elements movable in a cylinder core of the lock cylinder, said locking elements having contact surfaces which correspond to the member and configured for interacting with recesses provided in a cylinder housing of the lock cylinder outside a separation plane between the cylinder core and the cylinder housing, wherein the locking elements are configured for tracing the member or at least a region of the member and at least in part the profilings, and wherein a match resulting from said tracing enables a turning of the cylinder core.

2. The lock-key system of claim 1, wherein the at least one member represents a registered trademark.

* * * * *